US007316622B1

(12) United States Patent
Lucas

(10) Patent No.: US 7,316,622 B1
(45) Date of Patent: Jan. 8, 2008

(54) ADJUSTABLE GOLF PUTTER

(76) Inventor: Ron Lucas, 1409 Beulah Rd., Pittsburgh, PA (US) 15235

( * ) Notice: Subject to any disclaimer, the term of this patent is extended or adjusted under 35 U.S.C. 154(b) by 323 days.

(21) Appl. No.: 11/055,298

(22) Filed: Feb. 10, 2005

Related U.S. Application Data

(60) Provisional application No. 60/543,709, filed on Feb. 10, 2004.

(51) Int. Cl.
*A63B 69/36* (2006.01)
*A63B 53/04* (2006.01)

(52) U.S. Cl. ..... 473/239; 473/245; 473/246; 473/248; 473/288; 473/307; 473/251; 473/296; 473/334; 473/342

(58) Field of Classification Search ..... 473/244–248, 473/239, 296, 305–315, 334–339, 288, 340–341; 135/69; 16/429; 15/144.3, 144.4; 403/109.1, 403/109.2, 109.3, 109.4, 109.5, 109.6, 109.7, 403/109.8
See application file for complete search history.

(56) References Cited

U.S. PATENT DOCUMENTS 2,820,638 A * 1/1958 Morrison ..... 473/252
3,595,582 A * 7/1971 Chapman ..... 473/244
4,073,492 A * 2/1978 Taylor ..... 473/409
4,121,832 A * 10/1978 Ebbing ..... 473/335
4,163,554 A * 8/1979 Bernhardt ..... 473/255
5,328,185 A * 7/1994 Finnigan et al. ..... 473/294
5,533,730 A * 7/1996 Ruvang ..... 473/251
5,924,938 A * 7/1999 Hines ..... 473/307
6,203,443 B1 3/2001 Britton
6,413,168 B1 * 7/2002 McKendry et al. ..... 473/239
6,497,626 B1 * 12/2002 Sundberg ..... 473/248
6,641,487 B1 * 11/2003 Hamburger ..... 473/288
6,964,616 B2 * 11/2005 Dombrowski ..... 473/239
2003/0050131 A1 * 3/2003 Grace ..... 473/296
2003/0195053 A1 10/2003 Cameron
2003/0220149 A1 * 11/2003 Mills ..... 473/246

* cited by examiner

*Primary Examiner*—Sebastiano Passaniti
(74) *Attorney, Agent, or Firm*—Frederick L. Tolhurst, Esq.; Cohen & Grigsby, P.C.

(57) ABSTRACT

An adjustable putter 10 having a shaft (12) and a grip assembly (16) that is connected to the butt end of shaft (12). A hosel assembly (20) is connected to the tip end (18) of shaft (12) and a head assembly (22) is connected to the hosel assembly. The grip assembly is adjustable on shaft (12) to adjust the length of the putter. A collet (106) is angularly moveable in a housing (94) to adjust the lie and to determine the right-hand/left-hand sense of the putter. The loft is adjusted by substituting different collets (106) with passageways (108) having varying orientations in collet (106). The weight of the putter is adjusted by substituting various weights (156, 158) in the head assembly.

24 Claims, 10 Drawing Sheets

ADJUSTABLE GOLF PUTTER

CLAIM OF PRIORITY

This invention claims the benefit of U.S. Provisional Application No. 60/543,709 filed on Feb. 10, 2004.

BACKGROUND OF THE INVENTION

1. Field of the Invention

The presently disclosed invention concerns golf putters and, more particularly, golf putters having various user adjustments that determine the characteristics of the putter.

2. Discussion of the Prior Art

Golf putters have a number of details and styles that are intended to accommodate the user's preferences. For example, putters are found in three basic styles—standard, belly and extra long. Also, golf putters are defined in terms of their loft and whether the putters are left-hand or right-hand orientation. Other variables for putters include the face progression, the length, the composition of the putter face, as well as the weight of the putter.

In the prior art, some putters are known to be adjustable in various dimensions. For example, some putters have been known to be adjustable with respect to length while others have had adjustments for weight or lie. An example of such adjustable putters is found in U.S. patent Publication U.S. 2003/0195053 which discloses an adjustable putter having adjustments for loft and for weight. Another example is seen in U.S. Pat. No. 6,203,443, which has an adjustable lie and weight. Although some putters could adjust length and other putters could adjust loft, there was a need in the prior art for a putter that would adjust all of length, lie and loft dimensions. In addition, it was also desirable to have a putter that was capable of further adjustments such as styles, left-hand/right-hand orientation, and face progression.

SUMMARY OF THE INVENTION

In accordance with the subject invention, an adjustable putter includes a shaft and a grip assembly that is connected to one end of the shaft. A hosel assembly is connected to the other end of the shaft and a head assembly is connected to the hosel assembly. The disclosed putter has various adjustments by which the user can modify various features and dimensions of the putter.

Preferably, the grip assembly has alternative styles such as standard, belly and extra long styles, each of which can be incorporated in the adjustable putter that is disclosed herein. For each style of grip assembly, the effective length of the putter shaft can be adjusted to suit the user's preferences.

Also preferably, the head assembly of the adjustable putter can be adjusted to vary the lie and loft of the putter. In addition, the face progression of the putter can also be adjusted within limits that meet USGA rules concerning golf putters. Also, the putter can be adjusted to be made a left-hand putter or a right-hand putter.

With further regard to the grip assembly, a preferred grip assembly includes an index sleeve that is secured to the butt end of the shaft and that is adjustably secured to a selected style of grip housing—standard, belly or extra long. A selected style of grip housing is longitudinally secured to the index sleeve by a pin that engages a notched portion of the index sleeve. The index sleeve includes several notches that are located at various longitudinal positions along index sleeve so that the effective length of the putter can be adjusted by engaging the pin in the grip housing in different notches of the index sleeve. The putter also includes a torque shaft and locking nut combination by which the grip housing is locked to the index sleeve so that the grip housing is not angularly movable with respect to the index sleeve.

With further regard to the head assembly of the adjustable putter, the head assembly includes a putter head and a housing that is secured to the tip end of the shaft. A collet adjustably secures the putter head to the housing so that the lie and the loft of the putter are both adjustable. The face surface of the putter head is adjustable with respect to the putter shaft according to the orientation of a passageway through the collet so that the adjustable putter has an adjustable loft. To provide different degrees of loft, collets with different orientations of the collet passageway are used in the putter.

The face surface of the putter head is also adjustable with respect to the putter shaft according to the angular position of the collet in the housing. To provide different degrees of lie, the collet is angularly rotated within the housing.

The progression of the face surface of the putter head is also adjustable. To provide different face progression, an extension of stem of the putter head that passes through the passageway of the collet is secured within the passageway at different longitudinal positions.

To vary the disclosed adjustable putter as a right-had putter or a left-hand putter, the angular position of the collet in the housing is angularly rotated in the housing from one side of a position at which the putter shaft is oriented vertically, to the other side of the position at which the putter shaft is vertically oriented.

Also preferably, the weight of the putter head is adjustable by adding selected weights to the putter head. A key is provided for the adjustments to the weights, the position of the collet in the housing, and the position of the grip housing on the index sleeve so that the weight, loft, lie, right-hand/left-hand, face progression and style are all secured and difficult to change during the course of play.

Other features, objects and advantages of the presently disclosed invention will occur to those skilled in the art as a description of a presently preferred embodiment thereof proceeds.

BRIEF DESCRIPTION OF THE DRAWINGS

A presently preferred embodiment of the invention herein disclosed is shown and described in connection with FIGS. 1A-34 wherein.

DESCRIPTION OF A PRESENTLY PREFERRED EMBODIMENT

Figure 1A:
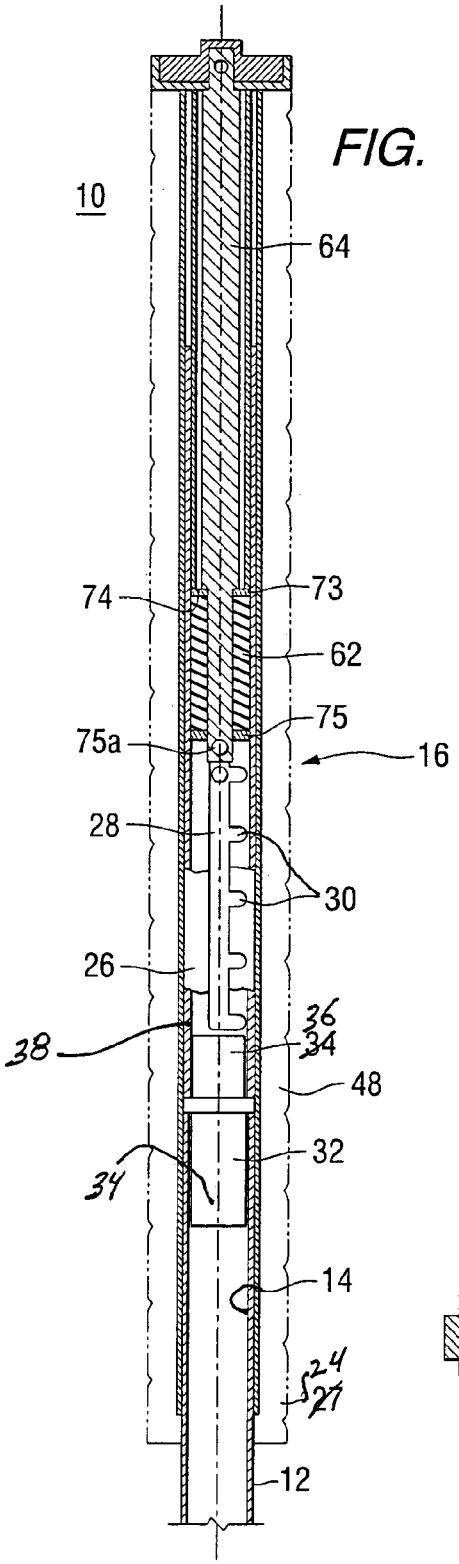
FIGS. 1A and 1B are a broken section of the adjustable putter showing the internal structure thereof as more particularly shown in FIGS. 2-34.
Figure 1B:
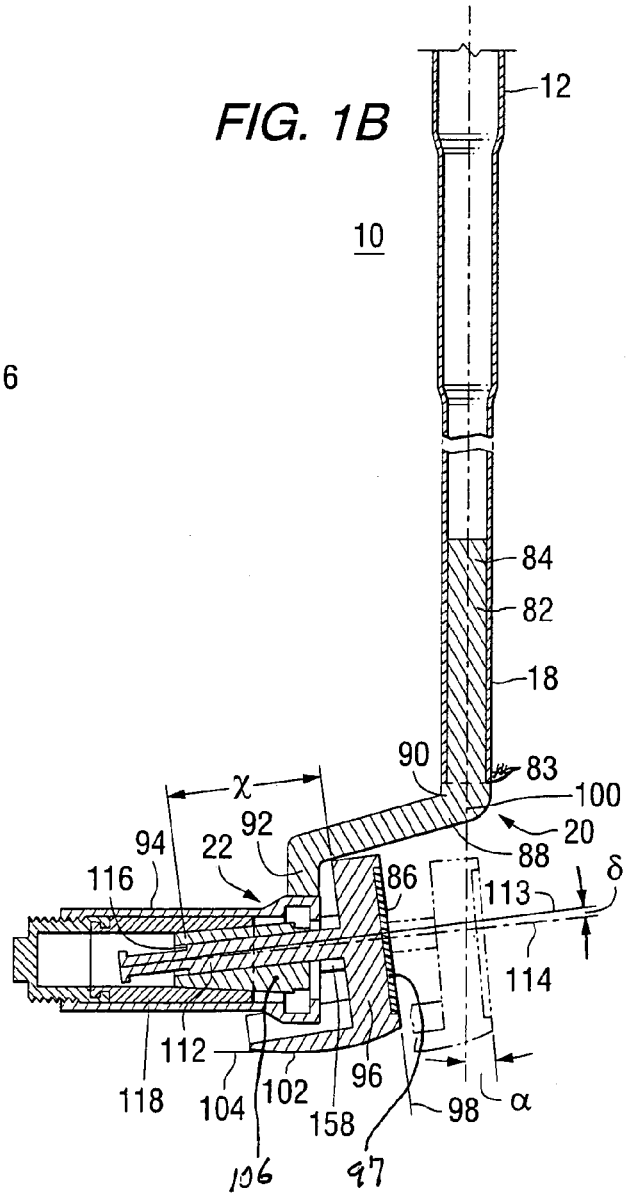
Figure 2:
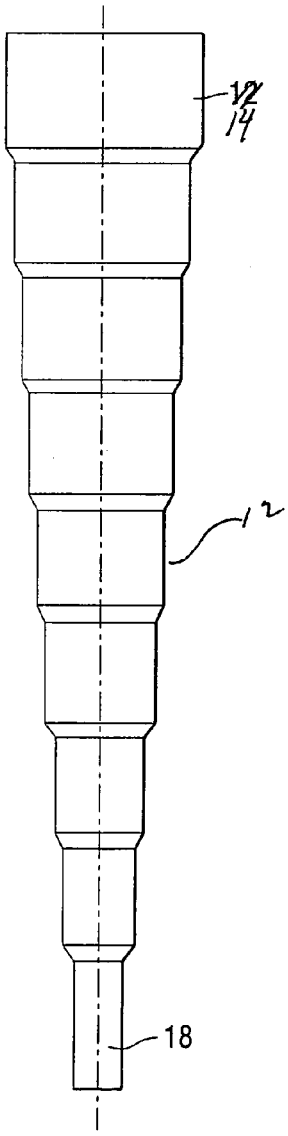
FIG. 2 is a detail drawing of the shaft that is shown in FIGS. 1A and 1B.
Figure 3:
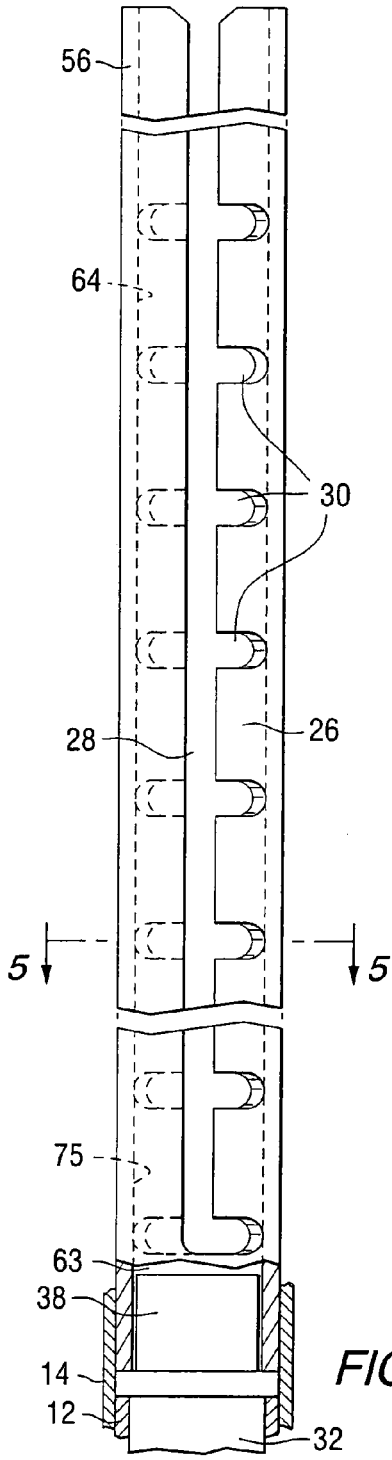
FIG. 3 is a detail drawing of the index sleeve that is shown in FIG. 1A.
Figure 4:
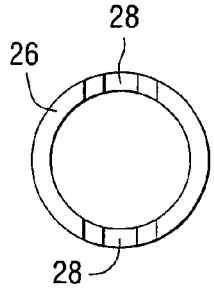
FIG. 4 is a top view of the index sleeve that is shown in FIG. 3.
Figure 5:
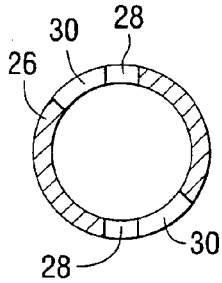
FIG. 5 is a cross-section of the index sleeve that is shown in FIG. 3 taken along the lines 5-5 of FIG. 3.
Figure 7:
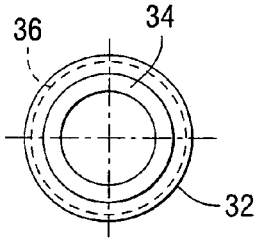
FIG. 7 is a top view of the coupling that is shown in FIG. 6.
Figure 6:
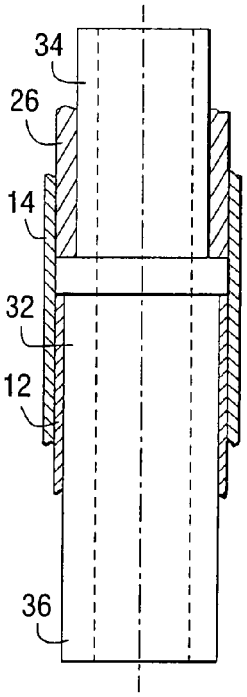
FIG. 6 is a detail drawing of the coupling that is shown in FIG. 1A.

As shown in FIGS. 1A and 1B, a golf putter 10 includes a shaft 12 having one end that is a butt end 14 that is secured to a grip assembly 16. Shaft 12 also has a second end that is a tip end 18 that is oppositely disposed on shaft 12 from butt end 14. The tip end 18 of shaft 12 is secured to a hosel assembly 20. A head assembly 22 is also secured to hosel assembly 20. Grip assembly 16 is further explained in connection with FIGS. 1A and 2-14, hosel assembly 20 is further explained in connection with FIGS. 1B and 15-17; and head assembly 22 is further described in connection with FIGS. 1B and 16-34.

FIG. 1A shows a grip assembly 16 having a regular grip 24. Alternatively, other grips within the scope of the presently disclosed invention include a belly grip and an extra long grip. Such other grips would incorporate grip assembly 16 in the same way as regular grip 24 and are also within the scope of the presently disclosed invention.

Grip assembly 16 includes an index sleeve 26 that is secured to butt end 14 of shaft 12. Index sleeve 26 includes a longitudinal slot 28 that defines a plurality of notches 30 along one side thereof. In the particular example of the preferred embodiment, notches 30 are located at longitudinal positions that are ½ inch apart over a range of four inches, although index sleeve 26 could also have notches 30 at other longitudinal positions. Index sleeve 26 is secured to butt end 14 of shaft 12 by a coupling 32. Coupling 32 has a first end 34 that extends into shaft 12 and a second end 36 that is located longitudinally opposite from the first end 34 and extends into a first end 38 of index sleeve 26.

Figure 9:
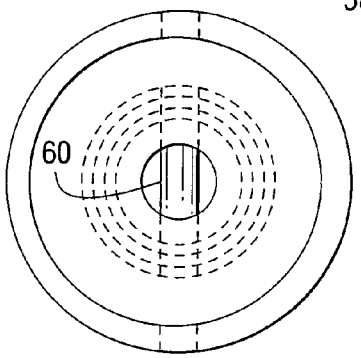
FIG. 9 is a top view of the grip housing that is shown in FIG. 8.
Figure 8:
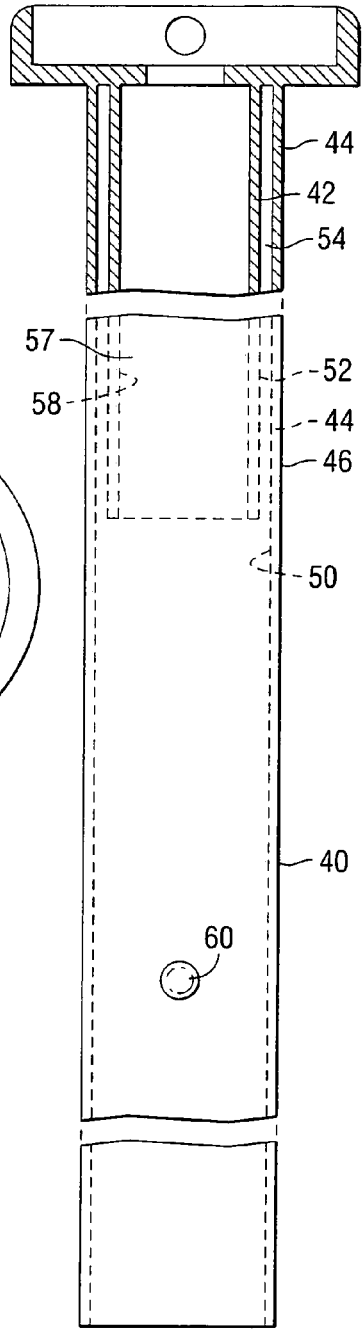
FIG. 8 is a detail drawing of the grip housing that is shown in FIG. 1A.

Grip assembly 16 further includes a grip housing 40 shown in FIGS. 1A, 8 and 9 that includes concentrically arranged internal cylinders 42 and 44. The exterior surface 46 of internal cylinder 44 forms a support surface for grip 24. The internal surface 50 of internal cylinder 44 and the exterior surface 52 of internal cylinder 42 define a cylindrical cavity 54. Cavity 54 receives the second end 56 of index sleeve 26 at times when grip housing 40 is connected to shaft 12 through coupling 32 and index sleeve 26.

Internal cylinder 42 of grip housing 40 defines an internal surface 58. Grip housing 40 includes at least one radial extension such as pin 60 that extends between opposing sides of the internal surface 50 of internal cylinder 44. To assemble grip housing 40 with index sleeve 26, the second end 56 of index sleeve 26 is inserted into the cylindrical cavity 54 with grip housing 40 and index sleeve 26 being at a relative angular positions such that pin 60 travels through longitudinal slot 28 in index sleeve 26.

When grip housing 40 has reached a selected longitudinal position with respect to index sleeve 26 and pin 60 is in registry with one of notches 30, then the grip housing is turned angularly with respect to index sleeve 26 to move pin 60 into one of notches 30. In this portion, pin 60 longitudinally maintains index sleeve 26 in grip housing 40. Alternatively, grip housing 40 could have more than one pin 60 located across cylinder 44. In that case, a plurality of pins 60 would move into a like number of notches 30.

To prevent the grip housing 40 from inadvertently moving angularly with respect to index sleeve 26 at times when the putter 10 is in use, the grip assembly 16 is further provided with a locking nut 62 that is located inside the cylindrical cavity 63 defined by index sleeve 26. When locking nut 62 is caused to radially expand, it engages internal surface 64 of index sleeve 28 and urges index sleeve radially against cylinder 44. This movement of locking nut 62 secures the internal cylinder 44 of grip housing 40 against index sleeve 26 to oppose angular movement of index sleeve 26 with respect to grip housing 40.

Figure 11:
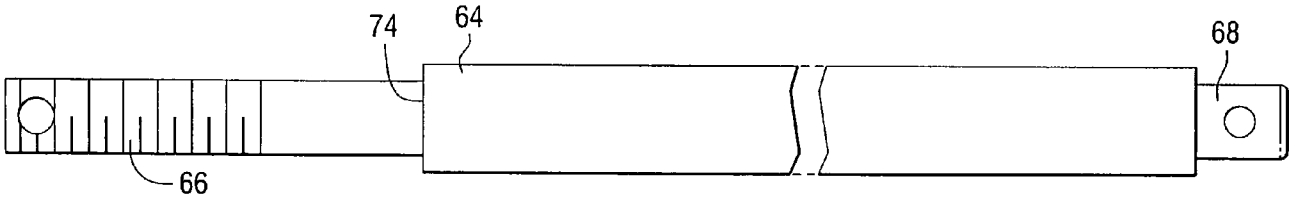
FIG. 11 is a detail drawing of the torque shaft that is shown in FIG. 1A.
Figure 10:
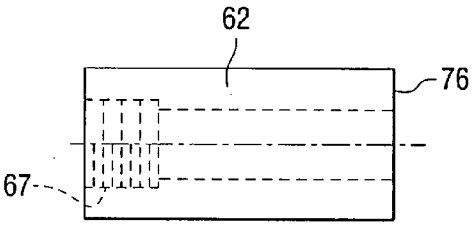
FIG. 10 is a detail drawing of the locking nut that is shown in FIG. 1A.
Figure 14:
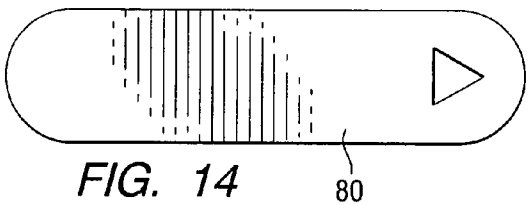
FIG. 14 is a detail drawing of a key that cooperates with the wrench cap of FIGS. 12 and 13.
Figure 13:
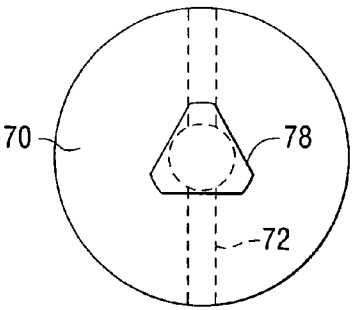
FIG. 13 is a top view of the wrench cap that is shown in FIG. 12.
Figure 12:
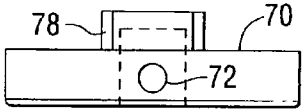
FIG. 12 is a detail drawing of the wrench cap that is shown in FIG. 1A.
Figure 15:
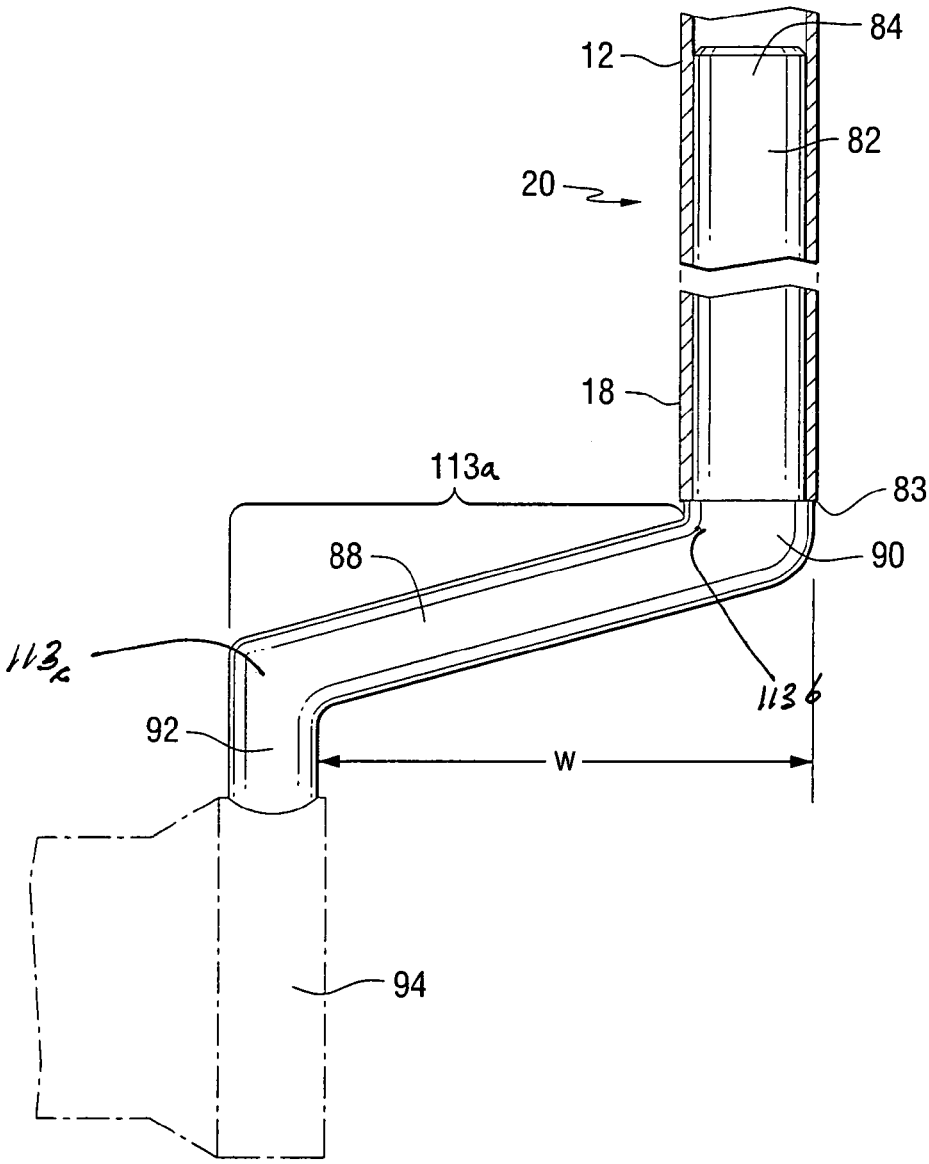
FIG. 15 is a detail drawing of the hosel assembly that is shown in FIG. 1B.
Figure 17:
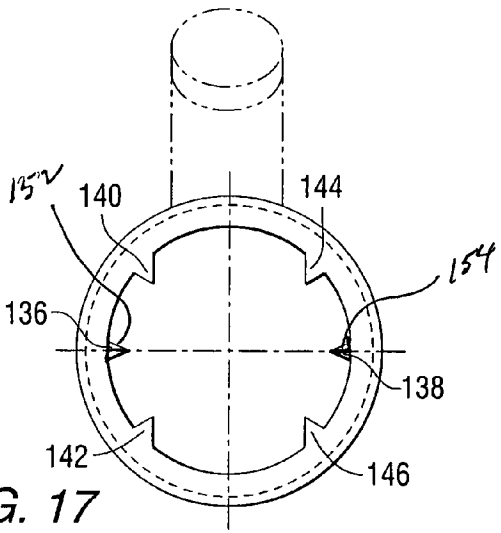
FIG. 17 is an end view of the housing shown in FIG. 16 that is taken along the lines 17-17 of FIG. 16.
Figure 16:
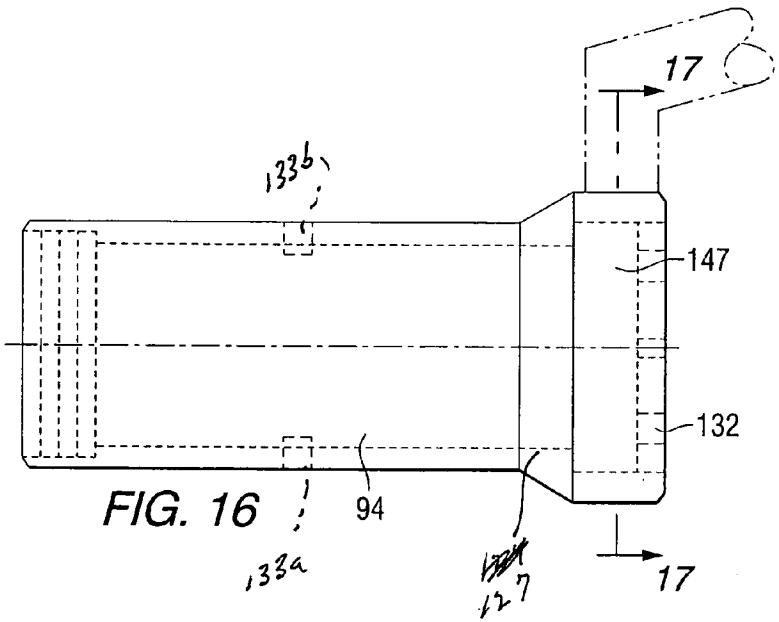
FIG. 16 is a detail drawing of the housing that is shown in FIG. 1B.
Figure 18:
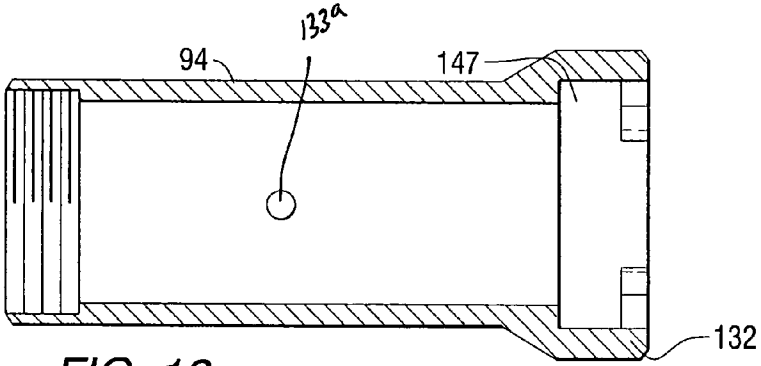
FIG. 18 is a plan cross-section of the housing that is shown in FIG. 16 taken along the centerline of the housing.

As shown in FIGS. 1A, 10 and 11, locking nut 62 is maintained on a torque shaft 64 that is rotated to cause locking nut 62 to radially expand. More specifically, torque shaft 64 extends through the cylindrical cavity 57 that is defined by the internal surface 58 of internal cylinder 42. Torque shaft 64 has a first end 66 that is threadingly connected to a threaded insert 67 that is included in locking nut 62. Torque shaft 64 also has a second end 68 that is connected to a wrench cap 70 by a pin 72. Torque shaft 64 further includes a shoulder 74. A serrated washer 73 is located on torque shaft 64 between shoulder 74 and one end 76 of locking nut 62.

As torque shaft 64 is rotated in a clockwise direction, the threaded portion of locking nut 62 travels away from end 66 of torque shaft 64 toward shoulder 74 and serrated washer 73. As the threaded insert 67 travels toward serrated washer 73 and shoulder 74, locking nut 62 is placed in compression between threaded insert 67 and serrated washer 73. The body of locking nut 62 is made of neoprene or other resilient, flexible material such that compression of locking nut 62 between the threaded connection with torque shaft 64 and serrated washer 73 causes the sides of locking nut 62 to radially expand. The radial expansion of locking nut 62 causes locking nut 62 to contact the internal surface 75 of index sleeve 26 and compress index sleeve 26 against cylinder 44.

When torque shaft 64 is rotated in a counterclockwise direction with respect to locking nut 62, the threaded portion of locking nut 62 travels away from shoulder 74 toward end 66 of torque shaft 64. This movement of the threaded end of locking nut 62 relieves the longitudinal compression on locking nut 62 so that the locking nut resiliently contracts in a radial direction. The radially inward movement of locking nut 62 relieves the pressure of index sleeve 26 against cylinder 44 such that internal cylinder 44 and grip housing 40 can be angularly rotated with respect to index sleeve 26. A flat washer 75 cooperates with a pin 75*a* that is fixed in the end 66 of torque shaft 64 so that the locking nut 62 cannot be disengaged from torque shaft 64 by the counterclockwise rotation of torque shaft 64.

Wrench cap 70 has a raised portion 78 by which the torque shaft 64 can be rotated. USGA rules require that an adjustable putter must have a mechanism to discourage modifying the putter adjustments during play. To comply with this rule, the adjustable putter disclosed herein is provided with a triangular raised portion 78. Raised portion 78 does not mate with conventional wrenches. Raised portion 78 mates with a specialty wrench or key 80 that engages raised portion 78 to rotate torque shaft 64.

With reference to FIGS. 1B and 15-17, in the presently preferred embodiment, hosel assembly 20 includes a hosel 82 that has a first end 84 that engages the tip end 18 of shaft 12. Preferably, hosel 82 fits internally into shaft 12 and is secured with an adhesive material. In this way, the disclosed putter more readily meets United States Golf Association (herein "USGA") specifications concerning the linear dimension between the putter face 86 and the intersection of hosel 82 with the external surface of shaft 12 as shown at 83 in FIGS. 1B and 15.

Hosel assembly further includes an arm 88. Arm 88 has one end 90 that is secured to hosel 82 and a second end 92 that is secured to a housing 94 that is included in the head assembly 22 as is hereinafter more fully explained. Preferably, arm 88 is secured to hosel 82 and housing 94 by permanent means such as welding or adhesive. Alternatively, arm 88 and hosel 82 could be formed as a single, unitary piece.

As particularly described in connection with FIGS. 1B and 16-30, head assembly 22 includes putter head 96 that includes a putter face 86. Putter head 96 includes a face insert 97 that defines putter face 86. Face insert 97 can be mounted either removeably or permanently in head 96. Face insert 97 is made of a soft metal such as brass. Also, face insert 97 can be made of steel, aluminum or a composite material. Face 86 is located at least partially in a plane 98. Plane 98 is oriented such that when plane 98 is extended to intersect the axis 100 of shaft 12, the included angle $\alpha$ is the loft angle for the putter 10. In the disclosed putter 10, the loft angle $\alpha$ is adjustable in quantum increments as is hereinafter more specifically explained.

Putter head 96 also includes a base surface 102. Base surface 102 is tangent to a plane 104. Alternatively, base surface 102 can also be at least partially included in plane 104. The minimum included angle between plane 104 and the axis 100 of shaft 12 defines the angle of lie $\beta$ of the putter 10. In the disclosed putter 10, the angle of lie $\beta$ is adjustable through a continuous range of angles that is within USGA limits for putter lie as is also hereinafter more specifically explained.

Putter head 96 is connected to a collet 106 that is adjustably secured in housing 94. Collet 106 has an internal passageway 108 that is broached through collet 106 at a predetermined angle $\gamma$ with respect to the longitudinal center axis 110 of collet 106. As is hereinafter more fully explained, collet 106 is angularly positioned within housing 94 to determine the angle of lie $\beta$ for putter 10 and also to determine the right-hand or left-hand sense of putter 10. As is also further described below, the angle $\gamma$ of passageway 108 cooperates with putter head 96 to determine the loft $\alpha$ of putter 10.

Putter head 96 includes a shaft or stem 112 for adjustably connecting the putter head to the collet 106. Stem 112 extends from putter head 96 at an orientation with respect to putter face 86 such that the axis 114 of stem 112 defines an angle $\delta$ with respect to the normal direction 113 from plane 98 of putter face 86. Stem 112 is included within the internal passageway 108 of collet 106 and stem 112 is secured to housing 94 by securing collet 106 to stem 112 and to housing 94. As will be apparent from the description of the preferred embodiment, the loft angle $\alpha$ is determined by the combination of angles $\delta$ of stem 112 and $\gamma$ of passageway 108. In practice, angles of 2° and 4° for loft $\alpha$ are most common.

When the pitch of stem 112 and passageway 108 are of the same sense, angles $\gamma$ and $\delta$ are additive. When the pitch of stem 112 and passageway 108 are of opposite sense, the angles $\gamma$ and $\delta$ offset. This structure of putter 10 allows the loft $\alpha$ to be adjusted in increments according to the degree and relative orientation of angles $\gamma$ and $\delta$. Thus, if angle $\delta$ is 3 degrees and the angle $\gamma$ of passageway 108 is 1 degree and angles $\gamma$ and $\delta$ are additive, then the loft $\alpha$ will be 4 degrees. Similarly, if angle $\delta$ is 3 degrees and the angle $\gamma$ of passageway 108 is 3 degrees and angles $\gamma$ and $\delta$ are additive, then the loft $\alpha$ will be 6 degrees. Also, if angle $\delta$ is 3 degrees and the angle $\gamma$ of passageway 108 is 5 degrees and angles $\gamma$ and $\delta$ are additive, then the loft $\alpha$ will be 8 degrees. In the preferred embodiment, the angles $\delta$ of stem 112 and $\gamma$ of passageway 108 are fixed. Thus, the loft $\alpha$ can be incrementally adjusted by substituting collets having different angles $\gamma$ of passageway 108.

In some cases, to provide a further selection of loft angles $\alpha$, a collet 106 can be angularly positioned so that the angle $\gamma$ of passageway 108 subtracts from the angle $\delta$ of stem 112. That is, if collet 106 is angularly positioned in housing 94 such that passageway 108 is of the opposite sense from angle $\delta$ of stem 112, then the angles offset and the loft angle $\alpha$ will be the difference between the two angles $\gamma$ and $\delta$. For example, if angle $\delta$ is 3 degrees and the angle $\gamma$ of passageway 108 is 1 degree and angles $\gamma$ and $\delta$ offset, then the loft $\alpha$ will be 2 degrees.

The arrangement of securing putter head 96 to housing 94 by collet 106 also affords putter 10 with a mechanism for continuous adjustment of the face progression of putter 10. The progression of the face 86 of putter head 96 is the radial position of face 86 with respect to shaft 12. Face 86 is continuously adjustable with respect to shaft 12 by moving the longitudinal position of stem 112 within passageway 108 of collet 106.

The disclosed putter also limits face progression to meet USGA limits. To establish the limit of face progression forward of the shaft 12, the cross-sectional area of stem 112 beyond a given dimension x from putter head 96 is reduced as shown by shoulder 116 of stem 112. The reduced cross-section of stem 112 causes the surface of stem 112 in the portion of stem 12 beyond the dimension x from putter head 96 to be outside of the range of deflection of the walls of passageway 108 at times when collet 106 is secured in housing 94. Thus, it is not possible to securely maintain the face 86 at a progression setting beyond that position because the collet 106 cannot secure stem 112 in the zone of the reduced cross-section of stem 112.

To establish the limit of progression offset from shaft 12, the arm 88 of hosel assembly 20 includes an offset region 113*a*. The length of region 113*a* between elbow 113*b* and 113*c* is limited so that when putter head 96 is closed against the end 132 of housing 94, the face surface 86 of putter head 96 is offset from the surface of shaft 12 that is most remote from face surface 86 by a dimension w that is ½ the diameter of a golf ball.

As shown in FIGS. 1B and 29-34 of the preferred embodiment, the stem 112 of putter head 96 is secured to housing 94 through collet 106 by the action of a wedge 118 that is also included in the head assembly 22. Wedge 118 is located inside housing 94. A threaded member 120 is threadingly engaged with housing 94 with one end 122 of threaded member 120 abutting an end 124 of wedge 118. Wedge 118 defines an internal fustro-conical section 128 and the external surface of collet 106 defines a conical section 130 that is dimensioned to be received in fustro-conical section 128.

As threaded member 120 is rotated in a clockwise direction, it travels longitudinally through housing 94 in the direction of a retention end 132 of housing 94. Threaded member 120 contacts wedge 118 and urges or pushes wedge 118 toward retention end 132 of housing 94. Housing 94 includes guide pins 133*a* and 133*b* that extend inwardly into housing 94. Guide pins 133*a* and 133*b* engage slots 133*c* and 133*d* in the outer surface of wedge 118 prevent wedge 118 from angularly turning as threaded member 120 pushes against wedge 118. Collet 106 includes a flange 126 that is located at the end 134 of collet 106 that is disposed most adjacent to retention end 132 of housing 94. Retention end 132 of housing 94 includes bisecting retainers 136 and 138 and stop retainers 140, 142, 144, and 146 that are hereinafter further described. Flange 126 has a diameter such that, for certain angular positions of collet 106 within housing 94, flange 126 interferes with retainers 136, 138, 140, 142, 144, and 146 so that flange 126 cannot longitudinally pass through housing 94 at the longitudinal position of retainers 136, 138, 140, 142, 144 and 146.

As threaded member 120 is rotated in the clockwise direction, threaded member 120 advances wedge 118 and collet 106 longitudinally through housing 94 until the flange 126 of collet 106 contacts retainers 136, 138, 140, 142, 144 and 146. At the longitudinal position where flange 126 of collet 106 contacts retainers 136, 138, 140, 142, 144 and 146, collet 106 is stopped from further longitudinal travel in housing 94. As threaded member 120 is turned further, it causes wedge 118 to advance or push on collet 106 and place collet 106 in compression between the fustro-conical surface section 128 of wedge 118 and end 122 of threaded member 120. This compression causes the walls of passageway 108 to inwardly deflect and secure the stem 112 of putter head 96 in collet 106.

When sufficient pressure has developed between the walls of passageway 108 and the stem 112 of putter head 96, collet 106 seizes the stem of putter head 96 within passageway 108. Similarly, when sufficient pressure has developed between the flange 126 of collet 106 and the retainers 126, 138, 140, 142, 144 and 147 of housing 94, frictional forces prevent collet 106 from angularly rotating within housing 94. In this way, putter head 96 is secured to housing 94 through collet 106.

Threaded member 120 has a head 147*a* with a perimeter configuration that mates with key 80. The use of key 80 and the configuration of head 147*a* which mates with key 80 is preferred because this discourages attempts to modify loft or lie during the course of play in violation of USGA rules. Preferably, the configuration of head 147*a* is equivalent to that of torque shaft 64 so that the same key can be used for both securing the grip assembly 16 and the head assembly 22.

As previously described herein, the disclosed putter 10 affords a continuous adjustment of the angle of lie β. As described above, the putter head 96 is connected to housing 94 through collet 106. As more specifically illustrated in FIGS. 20 and 23 and described in connection with FIGS. 16-18 and 24-28, the lie angle β is controlled by controlling the angular position of collet 106 within housing 94. FIGS. 16-18 and 24-27 show collet 106 and the location of retainers 136, 138, 140, 142, 144 and 146 in greater detail.

Figure 27:
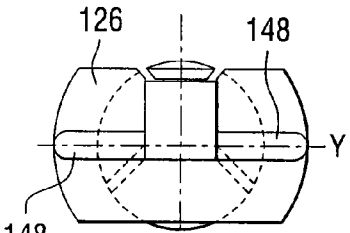
FIG. 27 is a right end view of the collet that is shown in FIG. 24.

Flange 126 of collet 106 has a major dimension y and a minor dimension z as shown in FIG. 27. Dimension y is sized to allow flange 126 to fit within an expanded portion 147 of housing 94 at any angular position of collet 106 with respect to housing 94. However, the y dimension of flange 126 is too large to allow flange 126 to pass into a narrower portion 127 of housing 94. Minor dimension z is sized to allow flange 126 to fit between the terminal ends of retainers 136, 138, 140, 142, 144 and 146 only at a selected angular position of collet 106 with respect to housing 94 in which the major dimension y of flange 126 is angularly positioned between retainers 140 and 144 and between retainers 142 and 146. At the selected angular position, the dimension is small enough that flange 126 will pass between the innermost or terminal ends of retainers 136, 138, 140, 142, 144 and 146. Thus, with collet 106 in the selected angular position so that flange 126 passes between the terminal ends of retainers 136, 138, 140, 142, 144 and 146, collet 106 can be inserted into and removed from housing 94 through the retainer end 132. After collet 106 is manually inserted into housing 94, collet 106 is angularly rotated with respect to housing 94. The angular position of collet 106 will then cause flange 126 to interfere with the narrower portion 127 of housing 94 and at least some of retainers 136, 138, 140, 142, 144, and 146 to longitudinally maintain the flange 126 of collet 106 within the expanded portion 147 of housing 94.

When collet 106 operates to secure putter head 96 to housing 94 as previously described, the angular position of collet 106 within housing 94 also determines the lie angle β of putter head 94. Therefore, the disclosed putter 10 affords adjustments to the lie angle β by adjusting the angular position of collet 106.

The orientation of putter 10 as a left-hand putter or a right-hand putter is determined by the sense in which collet 106 is oriented in housing 94. In the example of the preferred embodiment, flange 126 of collet 106 is provided with a bisecting fin 148. Also, housing 94 is provided with opposing bisecting retainers 136 and 138 that define the end of housing 94 into two semicircles. When fin 148 is adjacent to one side of bisecting retainers 136 and 138, the putter 10 is oriented as a left-hand putter. When fin 148 is adjacent to the opposite side of bisecting retainers 136 and 138, the putter 10 is oriented as a right-hand putter.

To comply with USGA rules, a putter must have a lie angle β of 80 degrees or less. To assure that the disclosed putter meets this rule, fin 148 is provided with a sloped top surface 150 and bisecting retainers 136 and 138 are provided with sloped interior surfaces 152 and 154. In this way, when flange 126 is urged against retainers 136 and 138 to secure the putter head 96 to housing 94, the top surface 150 of fin 148 cooperates with the interior surfaces 152 and 154 of bisecting retainers 136 and 138 to urge collet 106 to an angular position away from the angular position at which fin 148 coincides with the center of retainers 136 and 138. In this way, fin 148 is prevented from engaging the inner surface of bisecting retainers 136 and 138 to establish an angular position of collet 106 that results in a degree of lie that is contrary to USGA rules. The angular movement of collet 106 occurs according to the area and slope of surfaces 152 and 154 of top surface 150. By selecting the appropriate size and slope of surfaces 152 and 154 and top surface 150, fin 148 and bisecting retainers 136 and 138 cooperate to urge collet 16 away from an angular position at which the collet 106 would cause putter head 96 to have a lie angle β that is greater than 80 degrees.

The disclosed putter includes stop retainers 140, 142, 144 and 146 to provide a minimum limit for the degree of lie β. Specifically, collet 106 can be angularly positioned so that fin 148 is anywhere between bisecting retainer 136 and either stop retainer 140 (for a right-handed putter) or stop retainer 142 (for a left-handed putter). At the same time, fin 148 is correspondingly positioned between bisecting retainer 138 and either stop retainer 146 (for a right-handed putter) or stop retainer 144 (for a left-handed putter). Thus, the lie of putter head 96 is continuously adjustable within this range of angular position of collet 106. In the example of the preferred embodiment, the stop retainers are located such that the angle of lie β can be adjusted within the limits of 80° maximum lie and 60° minimum lie. In this way, the disclosed putter assures compliance with USGA rules concerning allowable limits for lie angle β.

Figure 19:
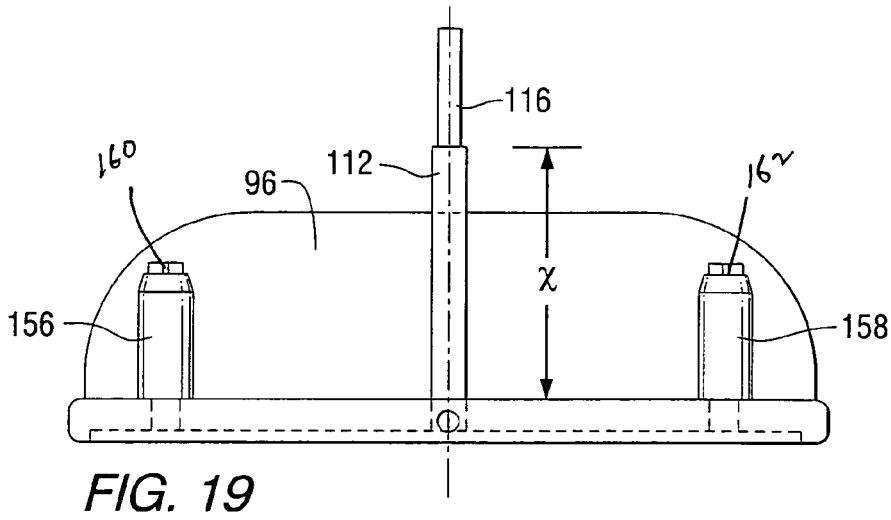
FIG. 19 is a detail drawing showing the top view of the putter head shown in FIG. 1B.
Figure 20:
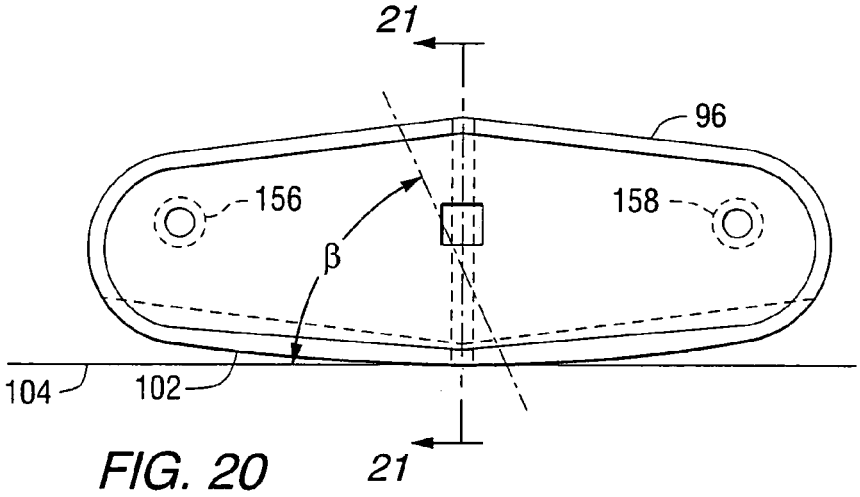
FIG. 20 is front view of the putter head shown in FIG. 19.
Figure 21:
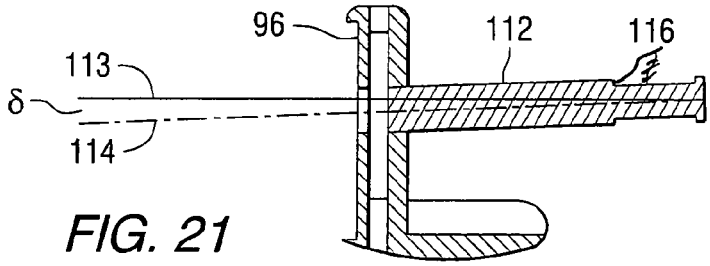
FIG. 21 is a side view of the putter head shown in FIG. 19.
Figure 22:
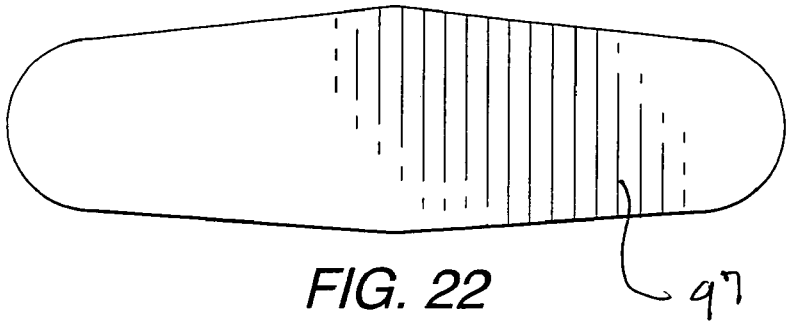
FIG. 22 shows an insert that is included in the putter head shown in FIGS. 19, 20 and 21.
Figure 23:
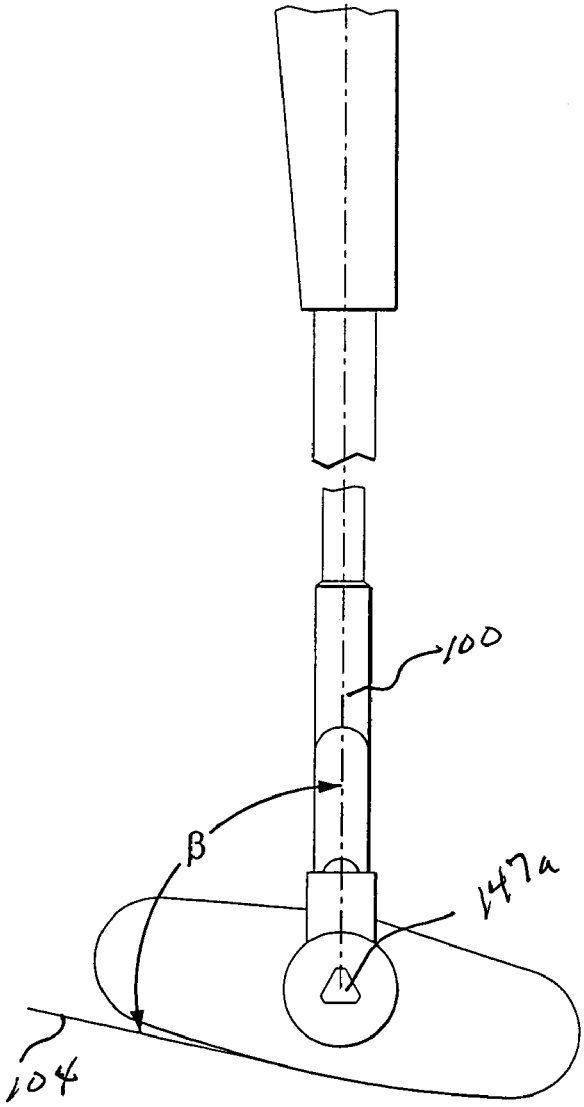
FIG. 23 shows the back view of the putter shown in FIGS. 1A and 1B.
Figure 25:
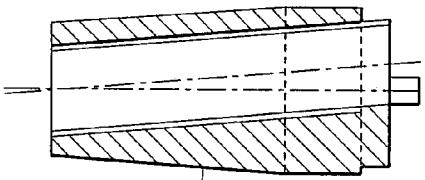
FIG. 25 is an elevation cross-section of the collet that is shown in FIG. 24.
Figure 24:
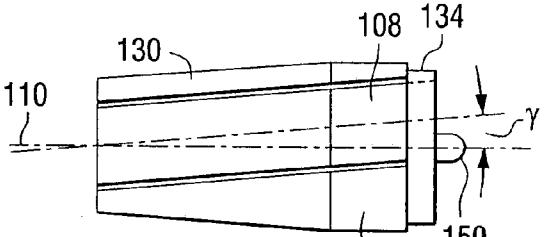
FIG. 24 is a detail drawing of the collet that is shown in FIG. 1B.
Figure 28:
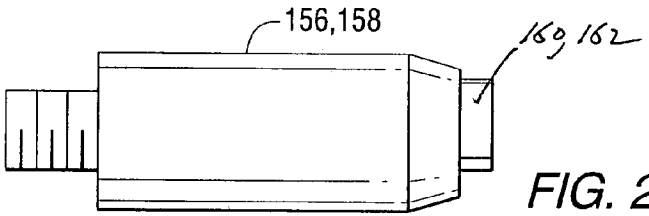
FIG. 28 is a detail drawing of a weight that is included in the putter head that is shown in FIG. 19.
Figure 26:
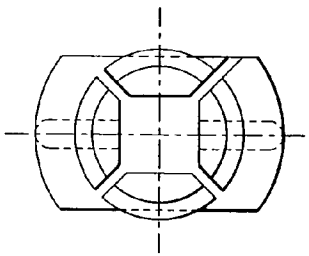
FIG. 26 is a left end view of the collet that is shown in FIG. 24.
Figure 30:
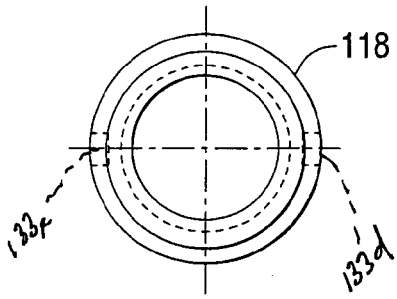
FIG. 30 is an end view of the wedge that is shown in FIG. 1B.
Figure 29:
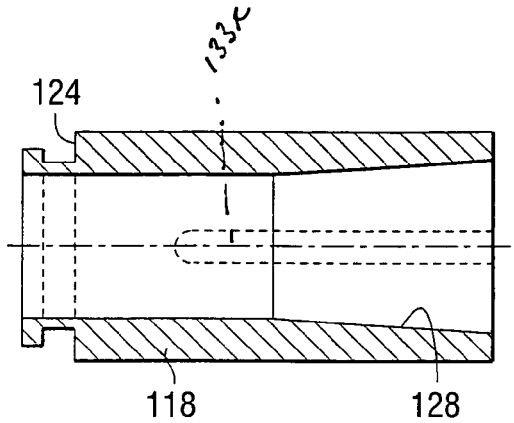
FIG. 29 is an elevation cross-section of the wedge that is shown in FIG. 1B.
Figure 32:
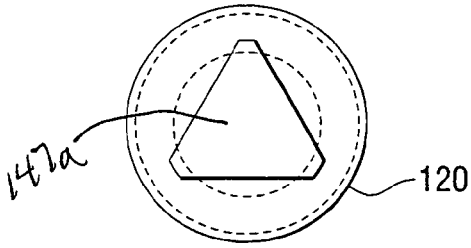
FIG. 32 is an end view of the threaded member that is shown in FIG. 31.
Figure 31:
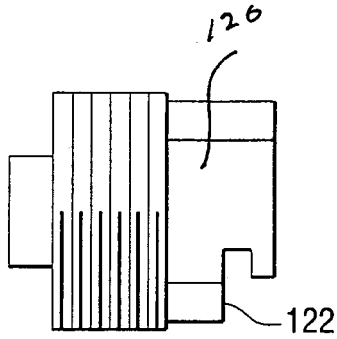
FIG. 31 is a detail drawing of the threaded member that is shown in FIG. 1B.
Figure 33:
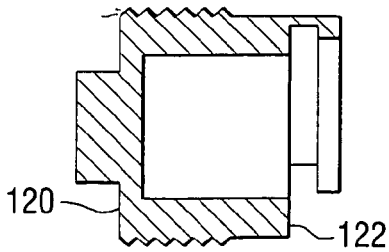
FIG. 33 is an elevation cross-section of the threaded member that is shown in FIG. 31.
Figure 34:
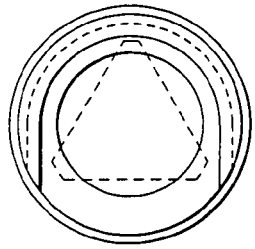
FIG. 34 is an end view of the threaded member that is shown in FIG. 31.

As particularly shown in FIGS. 1B, 19 and 28, the disclosed putter further includes an adjustment for the weight of the putter. Weights 156 and 158 can be removeably added to the putter head assembly to provide balanced weight in both the heal and toe of the putter. Preferably, weights 156 and 158 are threaded into the putter head and are provided with the same perimeter configuration at the distal ends 160 and 162 respectively as the head 147*a* of threaded member 122 and the raised portion 78 of wrench cap 70 so that they can be tightened and loosened with same key 80 that is used to tighten and loosen the grip assembly 16 and the head assembly 22 as previously explained herein. By having an array of weights with a range of varying mass, the weight of the putter can be adjusted by attaching various weights 156 and 158 to the putter head assembly. Since the heal and toe weights are added separately, the weight distribution within the head assembly can be further adjusted according to the users' preferences by using differently weighted weights in the heal and the toe.

The use of key 80 and the head configuration of weights 156 and 158 that mates with key 80 is preferred because this discourages changing weights 156 and 158 during the course of play in violation of USGA rules.

While a presently preferred embodiment of the disclosed invention has been shown and described herein, other embodiments of the invention also will be apparent from the forgoing description. Accordingly, the subject invention is not limited to any particular embodiment, but can be otherwise variously embodied within the scope of the following claims.

I claim:

1. A golf putter having:

a shaft;

a grip assembly that is adjustably engagable with one end of the shaft, said grip assembly including:

an index sleeve that is secured to said one end of said shaft, said index sleeve having a longitudinal slot with a plurality of notches therein;

a grip that is secured to a grip housing that has at least one radial extension that engages at least one of the notches of the longitudinal slot in the index sleeve when said grip is angularly rotated with respect to said index sleeve; and;

a locking nut that radially expands to engage an internal surface of said grip housing, said locking nut urging said grip housing against said index sleeve at times when said locking nut is radially expanded to prevent angular movement of said index sleeve with respect to said grip housing, said locking nut being threadingly connected to a torque shaft, said torque shaft also having an end that is connected to a wrench cap that is located at the distal end of said grip housing, said torque shaft being rotatable to control the radial expansion of said locking nut, a hosel assembly that is secured to the opposite end of the shaft from the grip assembly; and a head assembly that is secured to the hosel assembly, said head assembly including a putter face wherein the radial position of said putter face with respect to the axis of the shaft defines the progression of said putter face, the progression of said putter face being adjustable.

2. The putter of claim 1 wherein said grip assembly includes a regular grip.

3. The putter of claim 1 wherein said grip assembly includes a belly grip.

4. The putter of claim 1 wherein said grip assembly includes an extended grip.

5. The putter of claims 2, 3, or 4 wherein said head assembly further includes at least one weight that is removably connected to said head assembly to adjust the weight of said head assembly.

6. The putter of claim 1 further comprising a key that engages said wrench cap and rotates said wrench cap at times when said key is manually rotated.

7. The putter of claims 1, 2, 3, 4, or 6 wherein said head assembly includes:

a putter head that has a face surface that defines an angle with respect to the axis of said shaft to determine a loft angle for the face, said putter head also defining an angle with respect to the axis of said shaft to determine the lie angle of the putter head, a housing that is secured to the hosel assembly, and a collet that has an internal passageway and that is adjustably secured within said housing, said collet being angularly adjustable within said housing to establish the putter as a left-hand putter or right-hand putter.

8. The putter of claims 1, 2, 3, 4, or 6 wherein said head assembly includes:

a putter head that has a face surface, said face surface being located within a plane that intersects the axis of said shaft to define an angle with respect to the axis of said shaft, said angle being the loft angle of the face, said putter head also having a base surface, said base surface being located in or tangent to a plane that intersects the axis of said shaft to define an angle with respect to the axis of said shaft, said angle being the lie angle of the putter head, a housing that is secured to the hosel assembly, and a collet that has an internal passageway, said collet being adjustably secured to the housing and also being adjustably secured to the putter head, the orientation of said internal passageway through said collet controlling the loft angle of the face surface and the angular position of the collet within the cylinder controlling the lie angle of the putter head.

9. A golf putter having:

a shaft;

a grip assembly that is adjustably engagable with one end of the shaft;

a hosel assembly that is secured to the opposite end of the shaft from the grip assembly; and a head assembly that is secured to the hosel assembly, said head assembly including;

a putter head that has a face surface that defines an angle with respect to the axis of said shaft to determine a loft angle for the face, said putter head also defining an angle with respect to the axis of said shaft to determine the lie angle of the putter head, a housing that is secured to the hosel assembly, and a collet that has an internal passageway and that is adjustably secured within said housing, said collet being angularly adjustable within said housing to establish the putter as a left-hand putter or right-hand putter.

10. The golf putter of claim 9 wherein the radial position of said putter face with respect to the axis of the shaft defines the progression of said putter face, the putter head being adjustable within said collet to control the progression of said putter face.

11. The putter of claims 9 or 10 wherein said head assembly further includes at least one weight that is removably connected to said head assembly to adjust the weight of said head assembly.

12. A golf putter having:

a shaft;

a grip assembly that is adjustably engagable with one end of the shaft;

a hosel assembly that is secured to the opposite end of the shaft from the grip assembly; and a head assembly that is secured to the hosel assembly, said head assembly including;

a putter head that has a face surface, said face surface being located within a plane that intersects the axis of said shaft to define an angle with respect to the axis of said shaft, said angle being the loft angle of the face, said putter head also having a base surface, said base surface being located in or tangent to a plane that intersects the axis of said shaft to define an angle with respect to the axis of said shaft, said angle being the lie angle of the putter head, a housing that is secured to the hosel assembly, and a collet that has an internal passageway, said collet being adjustably secured to the housing and also being adjustably secured to the putter head, the axial orientation of said internal passageway through said collet controlling the loft angle of the face surface and the angular position of the collet within the cylinder controlling the lie angle of the putter head.

13. The putter of claim 12 wherein the radial position of said putter face with respect to the axis of the shaft defines the progression of said putter face, said putter head being adjustable within the passageway of said collet to determine the progression of said putter face.

14. The putter of claims 12 or 13 wherein the angular position of the collet within the housing is adjustable to determine the putter as a left-hand putter or right-hand putter.

15. The putter of claims 12, 13, or 14 wherein said head assembly further includes at least one weight that is removably connected to said head assembly to adjust the weight of said head assembly.

16. The putter of claims 12, 13, 14 or 15 wherein said head assembly further includes a wedge that is located inside said housing and also includes a threaded member that engages said housing and that contacts said wedge, said threaded member longitudinally forcing said wedge toward one end of said housing to secure the angular position of said collet within said housing and to secure said putter head within said collet.

17. The putter of claim 16 wherein said grip assembly includes a locking unit, said putter further comprising:

a wrench cap that is connected to one end of said threaded member; and a key that engages said wrench cap and that rotates said wrench cap and said threaded member with respect to said locking nut.

18. The putter of claims 12, 13, 14, 15 or 16 wherein:

said housing includes:

first and second bisecting retainers that are located adjacent to one end of said housing, said bisecting retainers being oppositely disposed on said housing with respect to each other and extending inwardly from the exterior of said housing; and at least two stop retainers, at least one of said stop retainers being associated with a respective one of each of said first and second bisecting retainers, each of said stop retainers being angularly positioned with respect to said bisecting retainer such that each of said bisecting retainers and the associated one of said stop retainers define a chord therebetween, and wherein said collet includes:

a flange that has a peripheral radial surface that is located at a radial position from the center axis of said housing that is less than the radial position of the inner surface of said housing, and that is greater than the innermost radial position of the first and second bisecting retainers such that said flange fits within the inner surface of said housing, but interferes with said bisecting retainers and with said stop retainers when said flange is located longitudinally against one end of said housing; and at least one fin that is attached to a peripheral portion of said flange, said fin extending longitudinally from said flange such that at times when said flange contacts said bisecting retainers and said stop retainers, said fin resides within the angular position of the chord that is defined between one of said bisecting retainers and one of said stop retainers.

19. The putter of claim 18 wherein two stop retainers are associated with each of said first and second bisecting retainers with each of the two stop retainers being angularly positioned on opposite sides of the bisecting retainer to define respective chords on each side of said bisecting retainer such that said putter is a right-hand putter at times when the fins are located on one side of said bisecting retainers and said putter is a left-hand putter at times when said the fins are located on the opposite side of said bisecting retainers.

20. The putter of claims 18 or 19 wherein the angular length of the chords that are defined between the bisecting retainers and the stop retainers determines the limits of the angle of the lie of the putter head.

21. The putter of claims 12, 13, 14, 15, 16, 17, 18, 19 or 20 wherein said putter head includes a stem that is fixed to a body, said stem defining an angle with the direction that is normal to the plane of said putter face, said stem extending into the passageway of said collet and cooperating with the orientation of said passageway to define the loft angle of the face.

22. The putter of claims 12, 13, 14, 15, 16, 17, 18, 19, 20, or 21 wherein the hosel assembly includes:

a hosel having a first end that fits inside said opposite end of the shaft from the grip assembly; and an arm that is secured to a second end of said hosel, said arm also being secured to the housing of the head assembly.

23. The putter of claims 12, 13, 14, 15, 16, 17, 18, 19, 20, 21, or 22 wherein said head assembly includes a face insert that is secured to the body of the head to define the head face.

24. The putter of claim 23 wherein said face insert is comprised of a material selected from the group consisting of brass, aluminum, steel, or a composite material.

* * * * *